US007690057B2

(12) United States Patent
Malassigne et al.

(10) Patent No.: US 7,690,057 B2
(45) Date of Patent: Apr. 6, 2010

(54) FOLDING FRAME MOTORIZED PRONE CART

(75) Inventors: Pascal Malassigne, White Fish Bay, WI (US); Jeffrey Harrow, Lutz, FL (US); Robert Jensen, Milwaukee, WI (US); John Erdman, Sturtevant, WI (US)

(73) Assignees: The United States of America as represented by the Department of Veterans Affairs, Washington, DC (US); Medical College of Wisconsin, Milwaukee, WI (US); University of South Florida, Tampa, FL (US)

( * ) Notice: Subject to any disclaimer, the term of this patent is extended or adjusted under 35 U.S.C. 154(b) by 0 days.

(21) Appl. No.: 12/134,147

(22) Filed: Jun. 5, 2008

(65) Prior Publication Data

US 2008/0301875 A1 Dec. 11, 2008

Related U.S. Application Data

(60) Provisional application No. 60/933,903, filed on Jun. 8, 2007.

(51) Int. Cl.
*A61G 7/08* (2006.01)
*A61G 7/015* (2006.01)
*A61G 7/018* (2006.01)

(52) U.S. Cl. ..... 5/86.1; 5/81.1 R; 5/618; 5/613

(58) Field of Classification Search ..... 5/86.1, 5/83.1, 81.1 R, 613, 616–618, 600; 296/20; 297/83, 86, 68
See application file for complete search history.

(56) References Cited

U.S. PATENT DOCUMENTS 782,335 A * 2/1905 Harvey ..... 297/83
847,619 A * 3/1907 Taylor ..... 5/618
923,729 A * 6/1909 Taylor ..... 5/618
1,243,887 A * 10/1917 Stark ..... 5/618
1,261,040 A * 4/1918 Lanes ..... 297/68
1,297,683 A * 3/1919 Hansen ..... 297/90
1,617,108 A * 2/1927 Gursky ..... 297/68
1,748,784 A * 2/1930 Mierley ..... 297/90
2,578,311 A * 12/1951 Lorenz ..... 297/86
3,003,160 A * 10/1961 Goodman ..... 5/618
3,010,121 A * 11/1961 Breach ..... 5/618
3,839,755 A 10/1974 Iannucci
4,099,277 A 7/1978 Watkins (Continued)

FOREIGN PATENT DOCUMENTS

EP 596115 A1 * 5/1994

OTHER PUBLICATIONS

Material Supplied by Inventors Showing Devices Known to Them (Undated).

*Primary Examiner*—Robert G Santos

(57) ABSTRACT

A prone cart for carrying a patient has a frame, a pair of independently powered and suspended drive wheels located centrally off the frame and an articuable body support having relatively moveable tray, chest support, abdominal support and leg support sections connected end to end for carrying a patient prone between a lowered position where the patient lies in a horizontal orientation to a raised position where the patient's head and chest are elevated with respect to the patient's abdomen and legs. Linkage mechanisms move the sections between the raised and lowered positions. A pair of independently suspended drive wheels mounted centrally of the frame is controllable so that each may each rotate independently in clockwise or counterclockwise sense so that the cart may be maneuvered in confined spaces with a zero turning radius.

21 Claims, 8 Drawing Sheets

U.S. PATENT DOCUMENTS

| | | | | | |
|---|---|---|---|---|---|
| 4,821,351 | A | * | 4/1989 | Bergenwall | 5/618 |
| 5,072,463 | A | * | 12/1991 | Willis | 5/618 |
| 5,418,988 | A | * | 5/1995 | Iura | 5/430 |
| 5,425,151 | A | * | 6/1995 | Iura | 5/618 |
| 5,444,883 | A | * | 8/1995 | Iura | 5/618 |
| 5,497,518 | A | * | 3/1996 | Iura | 5/618 |
| 5,634,221 | A | | 6/1997 | McKinney | |
| 5,868,461 | A | * | 2/1999 | Brotherston | 297/84 |
| 6,154,899 | A | * | 12/2000 | Brooke et al. | 5/81.1 R |
| 6,185,769 | B1 | * | 2/2001 | Larisey et al. | 5/648 |
| 6,230,346 | B1 | * | 5/2001 | Branson et al. | 5/618 |
| 6,381,781 | B1 | * | 5/2002 | Bourgraf et al. | 5/618 |
| 6,427,270 | B1 | * | 8/2002 | Blevins et al. | 5/613 |
| 6,691,349 | B2 | * | 2/2004 | Blevins | 5/613 |
| 2001/0008028 | A1 | * | 7/2001 | Blevins | 5/613 |
| 2004/0154097 | A1 | * | 8/2004 | Blevins | 5/81.1 R |
| 2006/0218724 | A1 | * | 10/2006 | Blevins | 5/81.1 R |
| 2008/0301875 | A1 | * | 12/2008 | Malassigne et al. | 5/618 |

* cited by examiner 10
12
14
16
18
20
21
30
32
33
38
40
42
44
46
48
50
52
54
56
58
62
64
66
68
70
72
74
74A
244
246
248
250

10
14
16
16R
18
18F
20
21
22
23
24
25
30
32
33
34
35
36
37
42
44
48
50
56
58
60
64
66
68
70
72
74
80
82
84
90
92
100
102
110
112
126
130
160
162
164
166
168
170
176
178
179
182
184
186
188
190
192
194
196
200
203
206
210
214
216
218
224
240
246

FOLDING FRAME MOTORIZED PRONE CART

RELATED APPLICATION

This application is based upon Provisional Application Ser. No. 60/933,903 filed Jun. 8, 2007, the teachings of which are incorporated herein by reference.

GOVERNMENT INTEREST

This invention was made with the support of the Department of Veterans Affairs, Government of the United States under a merit review grant to the Milwaukee and Tampa Veterans Affairs Medical Centers. The Government retains certain rights in the invention.

BACKGROUND OF THE INVENTION

The invention is directed to a folding motorized prone cart, and particularly to a prone cart having a folding frame or patient support capable of supporting and positioning the patient in a variety of positions for maximizing patient comfort and avoiding pressure ulcers and fatigue.

Prone carts are used to provide mobility and a more independent life style to individuals bedridden for weeks or months during the healing process of pressure ulcers, typically located in the sacral ischial or other areas of the body, that preclude their use of a wheelchair for mobility. In such cases the patients must lie in bed on a pressure-reducing surface, and be turned from side to side periodically. To get out of bed yet avoid putting pressure on their ischial or sacral surfaces, they need to lie face down and on their stomach in bed to avoid putting pressure on the areas adversely affected by the pressure ulcers or infection resulting therefrom.

It is therefore necessary to improve patient comfort and mobility with a prone cart that will support properly the patient and allow him/her to look around and have some permissible level of mobility in its surroundings.

Prone carts for carrying patients who have disabilities and/or are paralyzed take the form of wagon-like devices which allow the patient to lie on a body support or patient support in an horizontal reclined or prone position while being moved from place to place. Some carts are propelled manually by the patient, while others may be powered and have a control for the patient to steer and maneuver the cart independently.

Prone carts tend to be relatively long, because they carry a body support or patient support disposed horizontally. In order to accommodate patients of differing height, the patient support or body support is at least 180 cm long (six feet). When the body support is mounted on a wheeled frame, the length of the cart can exceed 180 cm (six feet) in length and is often as wide as or wider than a standard wheelchair. Accordingly, prone carts are difficult to maneuver and turn in tight spaces.

Steerable, self-powered prone carts are driven from front by direct arm movement. These carts allow the patient to move around the hospital or home environment, but with difficulty, because the cart has a large turning radius.

On some self-powered prone carts, the patient lies prone on a moveable body support which may pivot about a central horizontal axis such that the front of the body support may be elevated at an angle relative to the horizontal. Such an arrangement allows the patient to better visualize the environment, see ahead of the cart so that the patient can properly steer and direct the motion of the cart, and interact with other persons.

One such cart has a one-piece body support that pivots like a seesaw so that the patient can elevate his or her head to a more comfortable position. However, the one-piece body support does not tilt enough to allow the patient to recline with his or her head elevated sufficiently to be comfortable for an extended period of time. Also, because the body support is one piece, the patient is essentially supported by the same part of the body all the time which can result in discomfort and fatigue, and even the possible development of pressure ulcers elsewhere on the body.

Known prone carts do not have any place to conveniently store personal items or to allow the patient to write or read while in the prone position.

SUMMARY OF THE INVENTION

It is therefore an object of the invention to provide a prone cart which overcomes the shortcomings of the described prior arrangements.

It is another object of the invention to provide a prone cart which is easily maneuverable.

It is yet another object of the invention to provide a prone cart with an articulated body support which will allow the patient to position his or her body with the head comfortably elevated so that the patient can easily see ahead of the cart and so that the patient can interact with ambulatory persons without strain on the neck. The articulated body support will also allow the patient to be supported at the knees in a more natural position aiding comfort during extended periods of use.

The invention also allows the patient to reposition him or her self during the day to reduce fatigue and discomfort from single or fixed body support devices.

The prone cart of the invention provides a tray or work area where personal items may be stored and the body support may be moved without the items falling off.

The invention employs central drive wheels to power the prone cart for minimizing turning radius. In an exemplary embodiment, the turning radius is half of that required for a cart powered from the front or rear. In addition, the patient support is articulated so that overhang of the head and feet is reduced as the support is raised to the elevated position. This further reduces turning clearances and minimizes the turning radius in tight corridors or small bedrooms.

The prone cart of the invention comprises a frame having front and rear unpowered wheels rotatable about a vertical axis, and a pair of independently powered drive wheels located centrally of the frame between the unpowered wheels. The powered wheels are controllable so that each may rotate independently in clockwise or counterclockwise sense so that the cart may be maneuvered in confined spaces. In a particular embodiment the drive wheels are positioned centrally of the cart and the cart may be rotated 360 degrees in the horizontal about a central vertical axis.

The cart has a central axis running front to rear and a lateral transverse axis running side to side. A body support is mounted on a central pivot or support aligned with the lateral axis. The body support includes a tray; a chest or thoracic support; an abdominal support; and a leg support connected end to end. The chest support has a first end and a second end, the first end being pivotally connected to the main support for rotation between a generally horizontal lowered position and an inclined or elevated position. A single lift motor or actuator connected between the frame and the chest support drives the chest support between the lowered and inclined positions. The abdominal support has a first and second end, the first end being pivotally connected to the main support member for rotation between a generally horizontal upper position corresponding to the lower position of the chest support and an inclined or lowered position. The leg support has a first end and a second end, the first end being rotatably connected to the second end of the abdominal support. A first mechanism connects the chest support and the leg support; and a second mechanism connects the tray to the abdominal support. The single lift motor simultaneously raises the chest support and lowers the leg support through the first mechanism, and the second mechanism raises the tray and simultaneously lowers the chest support as the chest support is raised.

DESCRIPTION OF AN EXEMPLARY EMBODIMENT

Figures 1, 5:
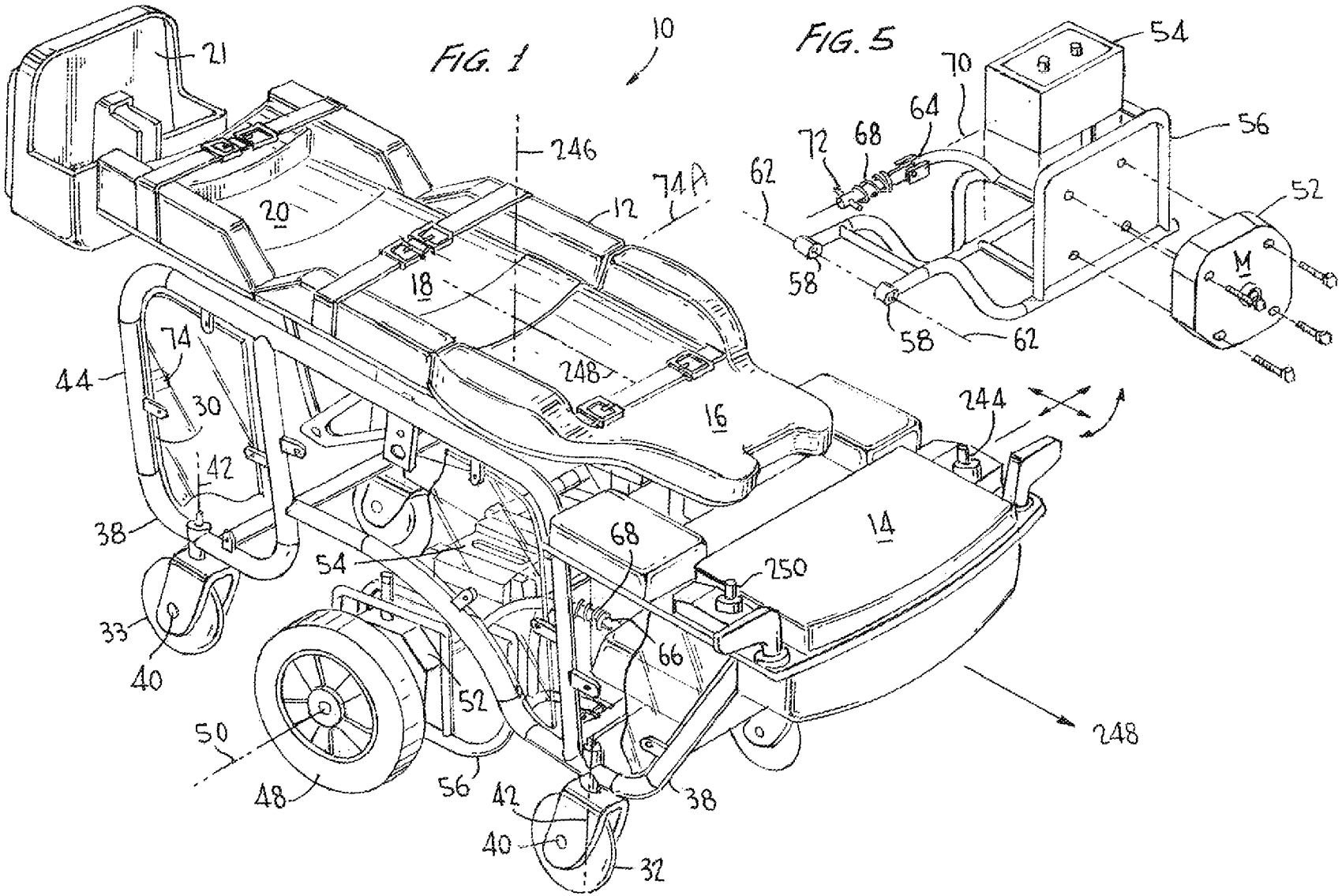
FIG. 1 is a perspective front end view of a prone cart with a body support having moveable sections.
FIG. 5 is an illustration of one of a pair of cradles each of which independently supports a drive wheel and motor.
Figure 2:
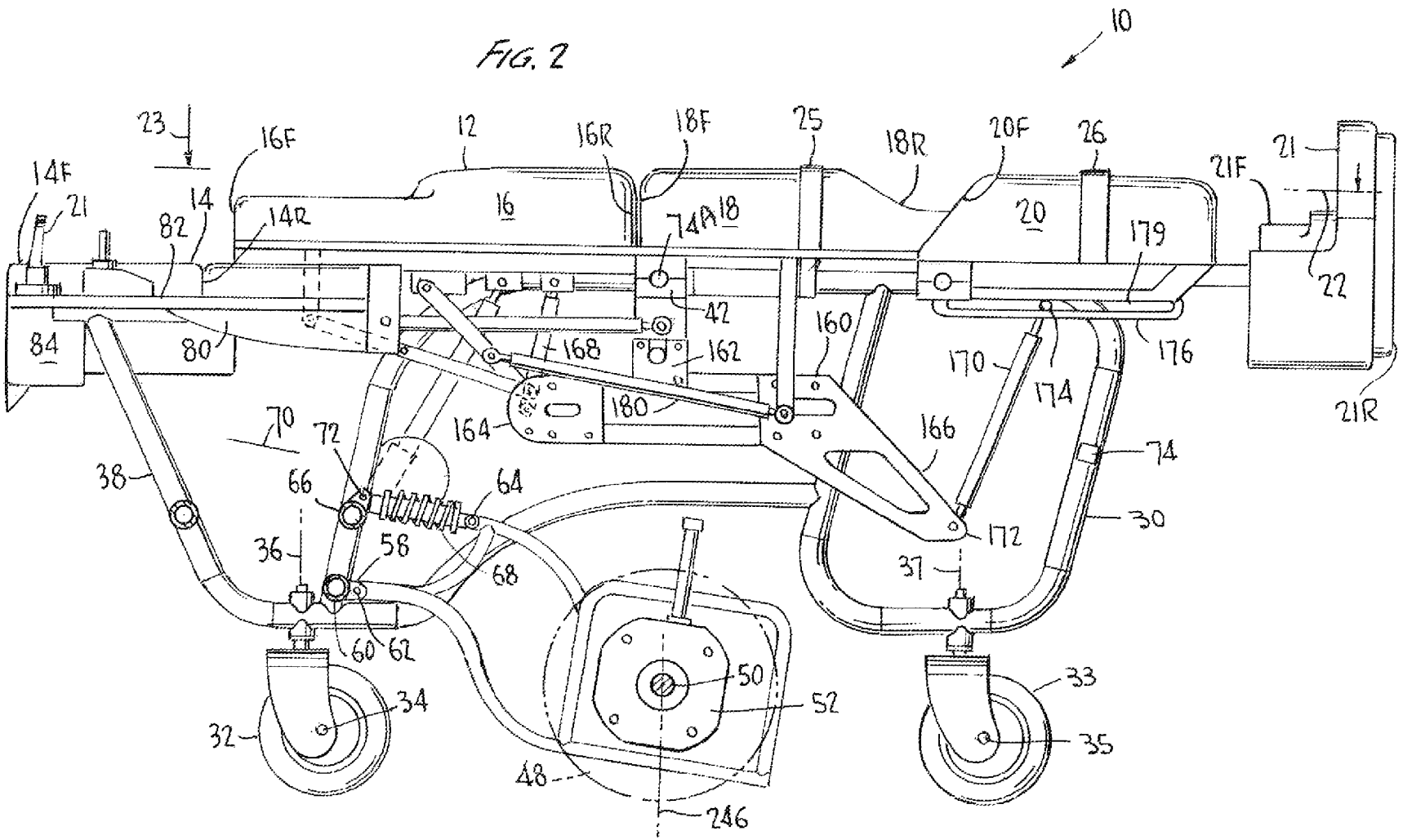
FIG. 2 is a side elevation of the prone cart illustrated in FIG. 1 with the body support in a lowered position.
Figures 3, 4:
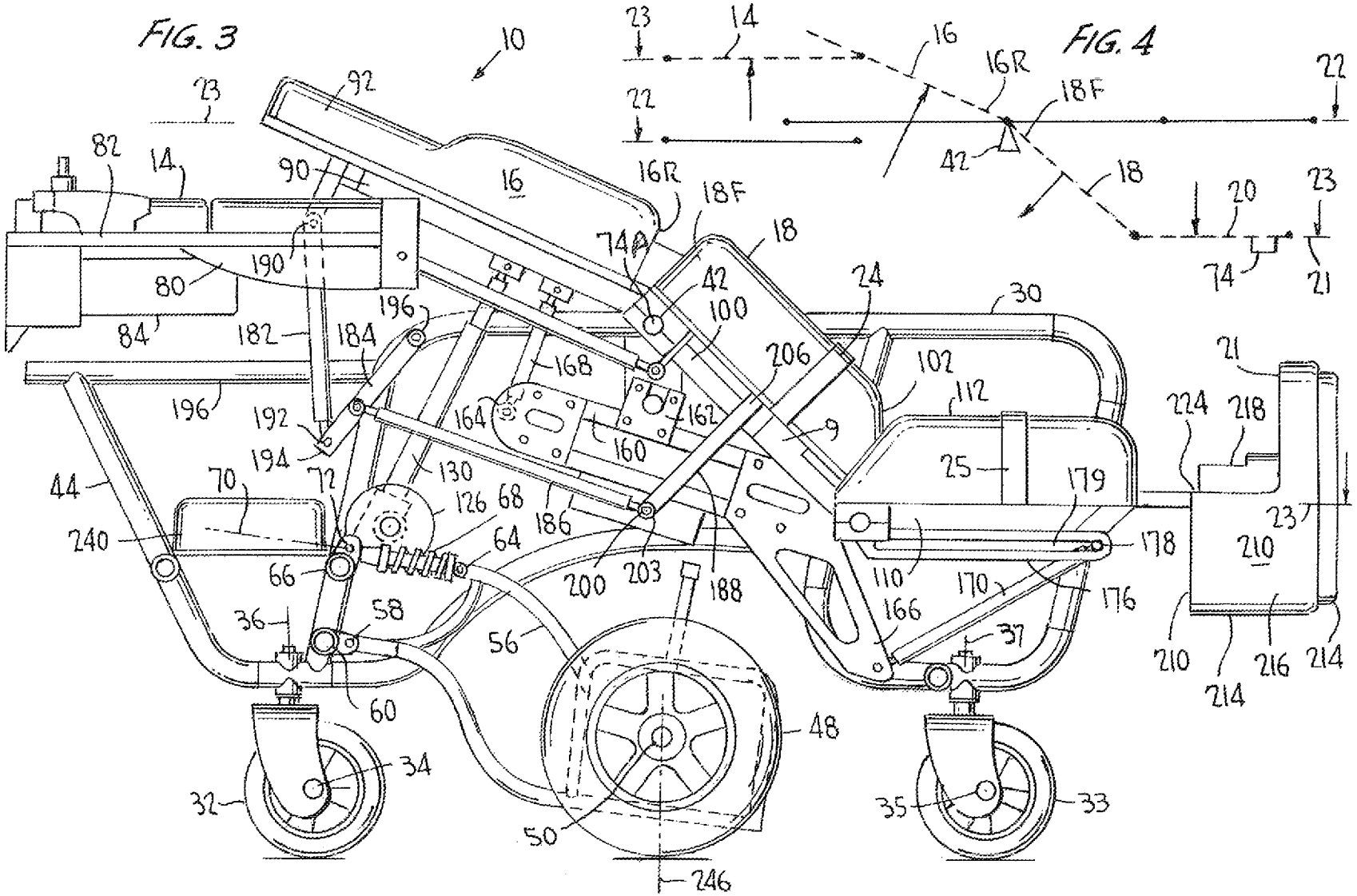
FIG. 3 is a side elevation of the prone cart illustrated in FIG. 1 with the body support in the elevated position.
FIG. 4 is a schematic illustration of the relative movement of the various sections of the body support between the lowered position and the elevated position.
Figure 6:
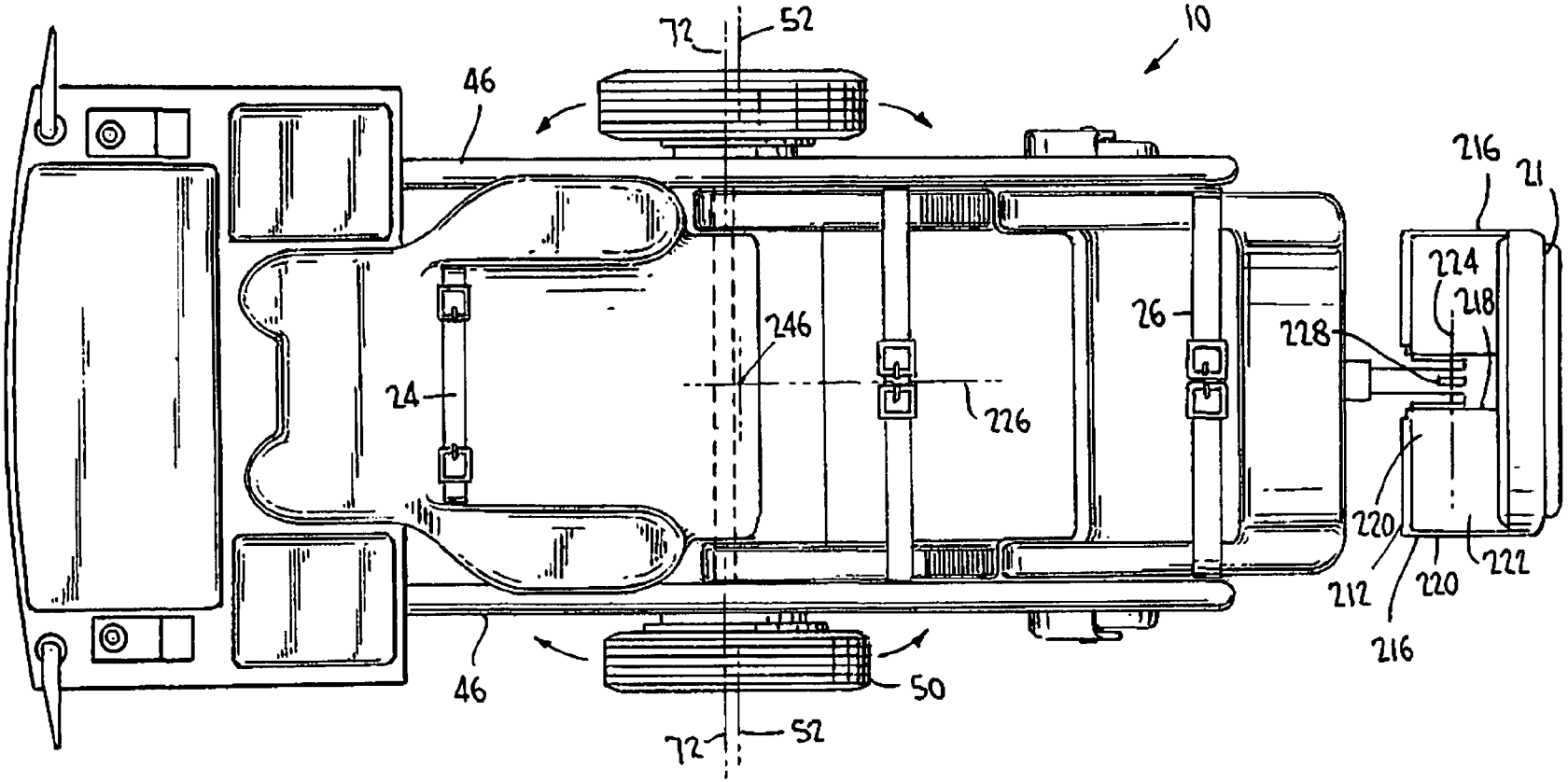
FIG. 6 is top plan view of the prone cart illustrated in FIG. 1.

FIGS. 1-3 generally illustrate an exemplary embodiment of a prone cart 10 for supporting a patient on an body support 12 which has several moveable or articuable sections including a tray section 14, a chest support section 16, an abdominal support section 18 and a leg support section 20 with an attached foot support 21 extending therefrom. The sections of the body support may be selectively positioned in order to allow the patient to be supported in various prone positions between a lower or fully horizontal prone position 22 (FIG. 2) to an elevated or raised position 23 (FIG. 3.)

The tray support section 14 has a front end 14F and a rear end 14R; the chest support section 16 has a front end 16F pivotally connected to the rear end 14R of the tray section 14 and a rear end 16R. The abdominal support section 18 has a front-end 18F pivotally connected to the rear end 16R of the chest support and a rear end 18R. Leg support section 20 has a front-end 20F pivotally connected to the rear end 18R of the chest support and a rear end 20R. The foot support 21 has a front-end 21F telescopically coupled to the rear end 20R of the leg support section and a free rear end 21R.

In FIG. 2 the patient (not shown) lies fully flat, and in FIG. 3 the patient (not shown) is supported so that the head and chest are raised and the abdomen and legs of the patient are lowered, thereby allowing the patient to be more comfortably positioned when the cart 10 is maneuvered about. It should be understood, as hereinafter described, that the patient may adjust the position of the body support 12 between the fully prone position 22 and the elevated position 23 as desired. It should be understood that in the prone position, the body support is generally horizontal. In the elevated position 23, the tray section 14 and chest support section 16 are elevated above the horizontal and the abdominal support section 18 and leg support section 20 are lowered relative to the horizontal.

The chest support section 16, the abdominal support section 18 and the leg support section 20 each have a corresponding safety belt 24, 25 and 26 for safely securing the patient to the body support.

The cart 10 has a frame 30 carried by front and rear wheels 32 and 33 positioned respectively at the corresponding front corners 38 and rear corners 38 thereof. The wheels 32 and 33 are mounted for rotation about a respective corresponding horizontal axis 34 and 35 for forward and rearward motion; and the wheels 32-33 are each attached to the frame 10 about a corresponding vertical axis 36-37 allowing the wheels to swivel 3600 thereabout for turning the cart.

The frame 30 includes side members 38 and cross members 40 joining the side members in parallel alignment as shown. As discussed hereinafter, various components of the body support, and various mechanical components are carried by the frame. For example, the body support 12 is pivotally secured to the frame by a main support or bearing 42 located between the rear end 16R of the chest support and the front-end 18F of the abdominal support. The body support 12 moves between the prone position 22 (FIG. 2) and the raised position 23 (FIG. 3) about the main bearing.

A pair of drive wheels 48 are positioned, as shown, more or less centrally of the frame 30. Each wheel 48 has a horizontal axis of rotation 50 and is connected to a corresponding electric drive motor 52 powered by a storage battery 54 carried by an independent suspension or cradle 56. Each cradle 56 has a pair of lower bearings 58 secured to a lower cross member 60 which is in turn secured to the side members 44 of the frame 30. The bearings 58 lie on a common horizontal lower axis 62. The cradle 56 has an upper bearing 64 coupled to upper cross member 66 by a spring loaded damper or shock absorber 68 which expands and contracts along upper axis 70. A free end of the shock absorber 68 is rotatably coupled to the upper cross member by bearing 72. The cradle 56 rotates about the lower axis 62 as the shock absorber takes up motion between the upper bearing 64 and the upper cross member 66. In the exemplary embodiment, the cradle 56 is positioned forward of the centrally located wheels. The cradles separately support each drive wheel 48 and drive motor 52, and thus each drive wheel 48 engages the ground independently, such that the corresponding rotational horizontal axis 50 is separately moveable upwardly and downwardly about the lower axis 62. In this way, as each wheel engages the ground it moves separately and independently from the other such that the frame remains generally unaffected by irregularities in the ground surface.

The frame is formed of tubular elements and has open areas 64. the open areas receive contoured transparent plastic sheets 66 which cover the openings but allow the mechanism to be visible. The transparent sheets 66 are held in position by clips 68 attached to the tubular parts of the frame as shown.

The rear end 16R of the chest support rotates about a pivot axis 72, coaxial with the main bearing 42, between the prone or horizontal position 22 upwardly to the elevated position 23. The front end 18 F of the abdominal support 18 rotates about the pivot axis 74A between prone position 21 downwardly as the chest support section 14 moves upwardly.

The leg support 20 has a front end 90 secured to the rear end 82 of the abdominal support 18 and a rear end 92 extending rearwardly of the frame as shown. The foot support 22 has a front end 94 secured to the rear end 82 of the leg support 20. The leg support 20 moves with the abdominal support 18.

FIGS. 1 and 3 show the body support 12 in the raised position 23 and the lowered position 22 respectively. In FIG. 1, the sections of the body support are generally aligned along a horizontal plane. In FIG. 3 the body support is in the raised position 24, which is to say that the body support in inclined with the tray 14 and chest support 16 raised above the horizontal and the abdominal support 18 and foot support 20 lowered below the horizontal as shown.

FIG. 4 schematically illustrates the positioning of the various sections of the body support 12 between the raised and lowered positions. As shown, the chest support 16 moves between the horizontal and the raised or inclined upper position about the pivot 72. The section 14 is carried from the lower position upwardly to the raised position as shown. The tray section 14, as herein after discussed, remains horizontal as it moves between the lower and upper positions.

The abdominal support 18 moves downwardly from the horizontal position when the chest support and tray move up. Likewise the leg support 20 moves down with the abdominal support. The leg support does not remain horizontal throughout its range of motion, but first moves with the abdominal support until its free or rear end 20R engages a stop 74 on the frame 30 whereupon the leg support comes to rest in the horizontal position.

Each of the sections of the body support 12 have an underlying support frame or deck member. For example the tray section 14 has a tray deck 80, a tray 82 carried by the tray deck 80 and a storage bin 84 supported by the deck 80 below the tray 82. The tray is slidably mounted to the deck 82 so that the patient may push the tray forward to reveal access to the bin 84. In this way, the position of the patient relative to the bin does not change when the bin is accessed, thereby adding a measure of comfort and convenience for the patient.

The chest support 16 has a chest support deck 90 carrying a shaped chest cushion 92 secured in overlying relation thereto. The abdominal support 18 has an abdominal support deck 100 carrying a shaped abdominal cushion 102 secured thereto in overlying relation thereto The leg support section 20 has a leg support deck 110 carrying a shaped leg cushion 112 secured thereto in overlying relation therewith.

The chest support deck 100 and the leg support deck 110 are pivotally connected by bearing 114 establishing an axis of rotation 116 about which the sections rotate. The leg support deck 110 is secured below the chest support deck 100. The abdominal support deck 100 has rear extensions 104 which engage the forward end of the leg support deck. The leg support deck 110 has a forward extension 118 extending forwardly of the bearing 116 and having an outboard or free end 120 and a distal or inboard end 122. The forward extension 118 normally engages the underside of the abdominal support deck 100 when the body support 12 is in the prone position 22, such that, the leg support deck 110 is maintained in alignment as a cantilever extending from the rear end 100R of the chest support deck 100 as it is lowered when the body support is itself lifted to the raised position.

The leg support deck 100 is positioned below and overlaps with the abdominal support deck 110. Thus the extension 118 acts as a cantilever for carrying the leg support. Thus, when the body support is in the lower position, the extension 118 engages the underside of the abdominal support deck 100 such that the leg support deck 110 is held horizontally and in alignment with the abdominal support as shown in FIG. 2.

The frame 30 has a pair of stops 74 mounted inwardly for engaging the underside of the leg support deck 110 near the rear end 20R of the leg support section 20. As the leg support section 20 moves downwardly the frame 118 engages the stops 74 whereby the leg support section rotates relative to the abdominal support 18.

As shown, the abdominal support section 18 moves downwardly to a point where its rear end 18R is more or less aligned horizontally with respect to the stops 74. Accordingly, the leg support comes to rest in the horizontal position when the abdominal support comes to rest at the end of its downward motion. The position of the stops may be changed or adjusted so that the leg support may come to rest in a different orientation as desired. Thus the rear extensions 104 of the chest support deck and the forward extensions 118 of the leg support deck cooperate to lift the leg support and allow it to articulate to the horizontal rest position when it engages the stops 74.

The leg support deck 110 has a rear or free end 124. As shown in FIGS. 2 and 3, the leg support deck is free to rotate upwardly (counter clockwise) as it moves downwardly from the prone position 22 (FIG. 2) with the abdominal support deck 100 as the body support 12 is raised or lifted to the elevated position 23 (FIG. 3). As the leg support deck 110 moves with the abdominal support deck 100, the free end 124 moves downwardly and engages the frame stops 74. As a result, the leg support deck 110 rotates upwardly or counterclockwise with respect to the abdominal support deck 100. When the latter comes to rest, the leg support likewise comes to rest at a generally horizontal orientation, as shown in FIG. 3.

FIGS. 2 and 3 illustrate components for raising and lowering the body support 12. A lift motor or actuator 126 is mounted to an intermediate cross member 128 connected between the sides 44 below and forwardly of the bearings 58. The motor or actuator 126 has a telescopic screw drive 130 connected thereto which extends towards and is pivotally coupled to the underside of the chest support deck 100. The screw drive 130 extends between a retracted position, shown in FIG. 2 when the body support is in the lower or prone position 22, to an extended position, shown in FIG. 3 when the body support is in the raised position 23. When energized, the motor or actuator 126 activates the screw drive 130 which telescopes upwardly driving the chest support deck 100 upwardly about the axis 74A.

The rear end 14R of the tray section 14 is secured to the front end 16F of the chest support section 16. The tray support deck 80 has a pair of lateral bearings 134 connected to corresponding lateral bearings on the chest support deck 90. As the front end 16F of the chest support deck 90 16 is raised, the rear end 14R of the tray deck 80 is raised.

Figure 8:
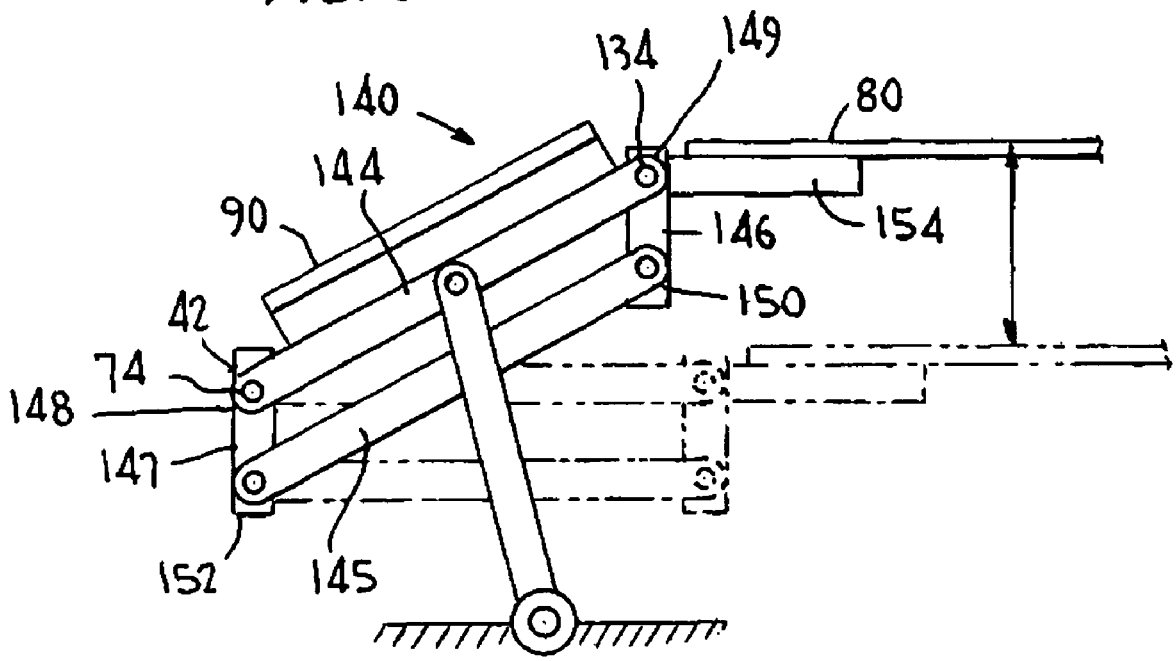
FIG. 8. is a fragmentary illustration of a four bar linkage employed for controlling the orientation of a tray.
Figure 10:
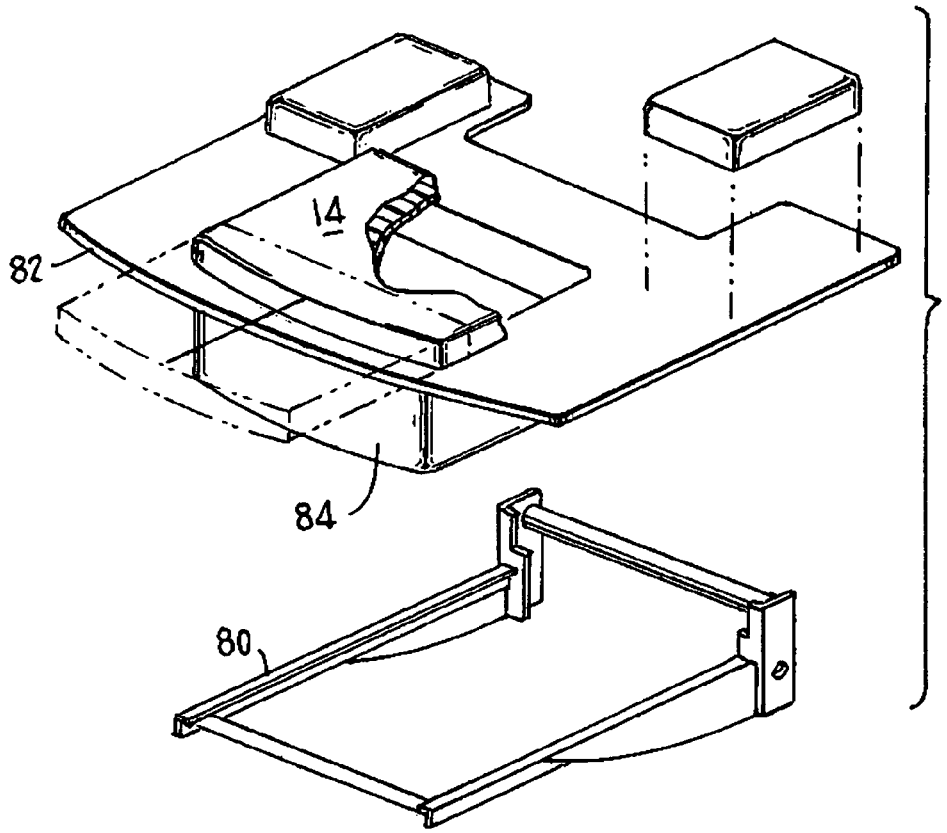
FIG. 10 is an exploded perspective view of the tray forming a section of the body support.
Figure 11:
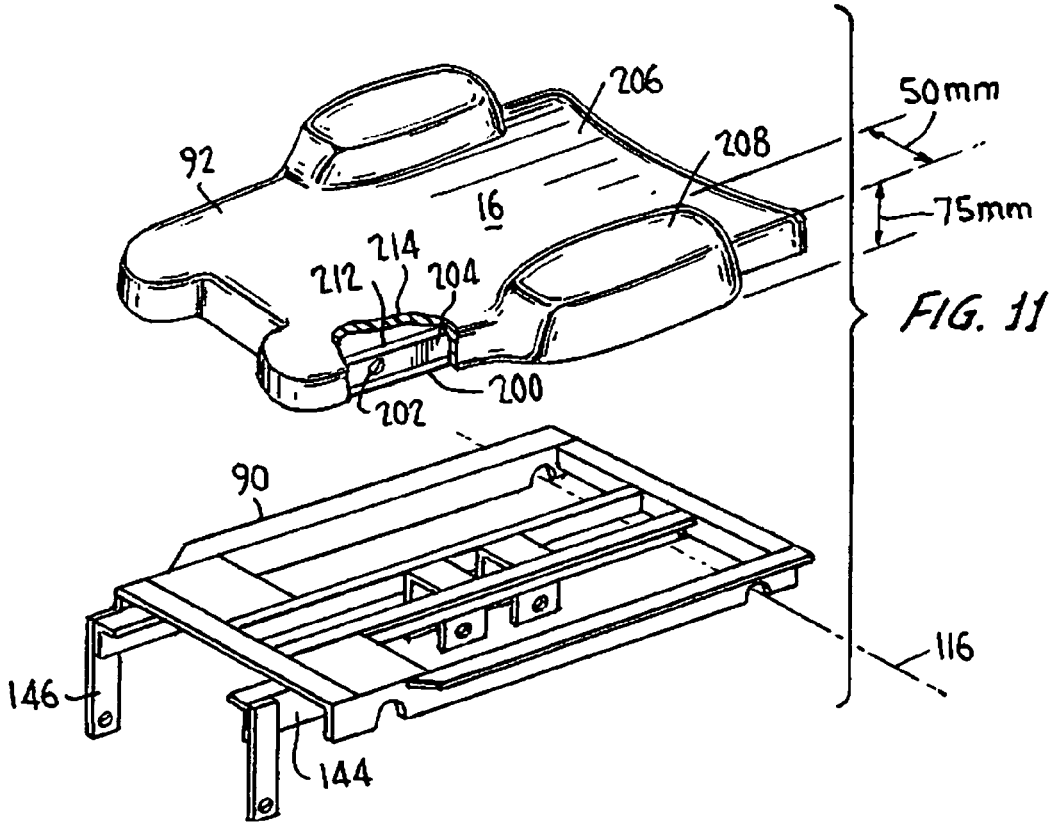
FIG. 11 is an exploded perspective view of a chest support forming a section of the body support.
Figure 12:
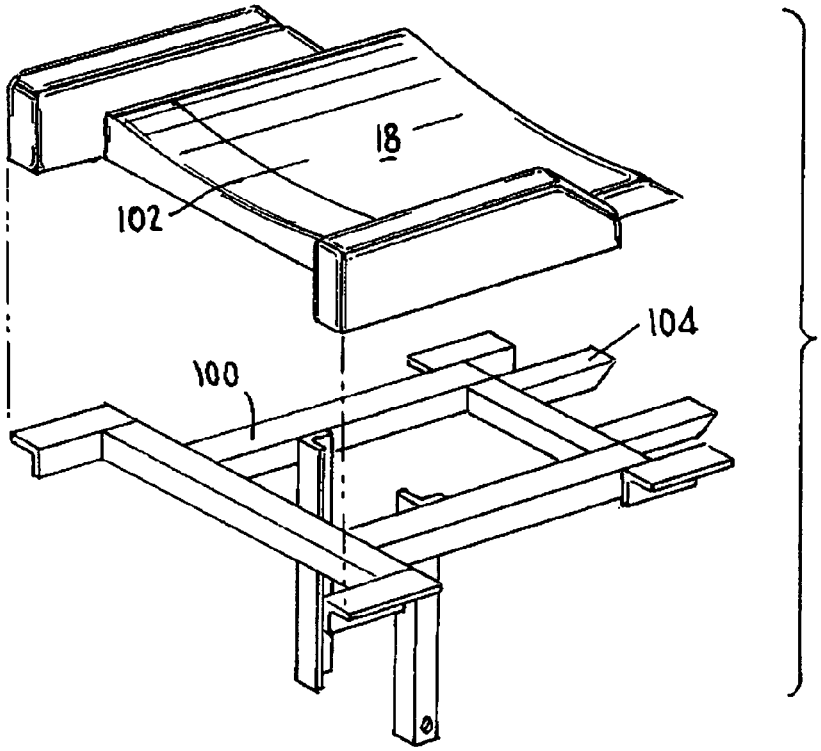
FIG. 12 is an exploded perspective view of an abdominal support forming a section of the body support.
Figure 13:
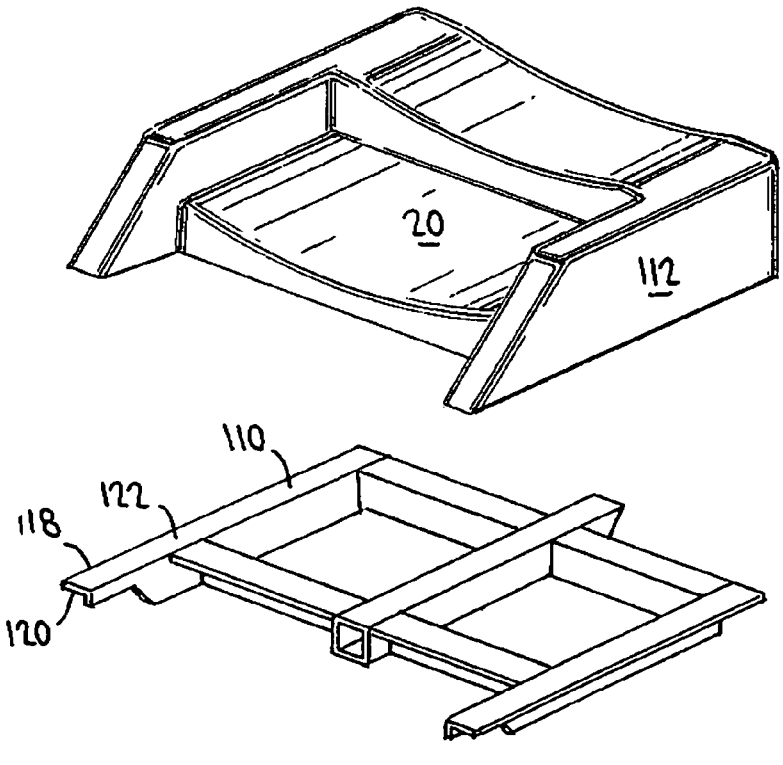
FIG. 13 is an exploded perspective view of a leg support forming a section of the body support.

As noted above the tray support section 14 remains horizontal as it moves up and down. This is necessary because the patient is likely to carry personal items on the tray 82 or in the drawer below, and it is not desirable for the tray to tilt as the tray 82 is raised and lowered as such personal objects may slide or fall of the tray. Accordingly, as shown in FIG. 8, the tray section 14 is equipped with a four bar linkage 140 for maintaining the tray support deck 80 in a horizontal orientation.

The four bar linkage 140 includes a pair of elongated upper and lower parallel bars 144-145 which extend generally lengthwise of the chest support section 16; and a pair of relatively short forward and rearward parallel vertical bars 146-147 which extend downwardly from the underside of chest support deck 90. The upper bar 144 is an integral part of the chest support deck 90 and moves with it. The rearward bar 147 extends downwardly from the main bearing 42 which rotates about axis 74A. The rearward bar 147 has an upper end 148 fixedly attached to the frame 30 for maintaining the rear bar in a fixed vertical position and extending downwardly from the bearing 42. The upper end 149 of forward bar 146 is rotatably secured to the tray support deck 80 at the forward end 16F of the tray support deck 90, and the bar 146 has a free lower end 150. The lower bar 145 is connected between the lower end 152 of the rear bar 145 and the lower end 150 of the forward bar 146.

The forward bar 146 has a forwardly extending leg 154 which is fixedly secured to or is an integral part of the tray support deck 80. The chest support deck 90 carries the four bar linkage 140 up and down as it is driven by the motor or actuator 120 and screw drive 122. The forward bar 146 remains vertical it moves up and down, because the lower bar 145 establishes a rotational radius extending between the lower end 152 of the rear bar 147 to the lower end 150 of the forward bar 146. Likewise the forwardly extending leg 154 secured to or integral with forward bar 146 remains in the horizontal position as the forward bar moves up and down. The four bar linkage 140 thereby maintains the tray section 14 in a horizontal orientation as the tray moves between the lower and raised positions.

The various sections of the body support move in a coordinated fashion. As noted above the chest support section moves up and down with the motor. The tray section moves with the chest support section. As hereinafter described, the abdominal support moves with the tray section and the leg support moves with the chest support section.

As shown in FIGS. 2 and 3, a rocker beam 160 is rotatably secured to a bearing 162 fixed to the frame 30 below the pivot axis 74A. The beam 160 has a forward end 164 and a rearward end 166. The forward end 162 of the beam 160 is pivotally secured to the underside to of the chest support deck 90 by an interconnecting linkage 168. Thus, as the chest support deck 90 is raised, the forward end 164 of the beam 160 rotates upwardly.

The rear end 166 of the beam 160 is coupled to a linkage 170 having a proximate end 172 pivotally connected thereto and a distal end 174 slideably connected to a slotted member 176 secured to the underside of the leg support deck 110. The slotted member 176 has an elongated slot 178 extending longitudinally of the leg support deck 110.

The abdominal support deck 100 is linked to the tray support deck 80 by a linkage mechanism 180 which causes the abdominal support deck 100 to rotate in the downward direction when the tray deck 80 moves upwardly. As noted above, when the chest support section 16 is driven up and down, the tray support section 14 follows, but remains horizontal.

The linkage mechanism 180 connecting the tray support deck 80 and the abdominal support deck 100 includes first, second, third and fourth links 182, 184, 186, 188. The first link 182 has a proximate end 190 pivotally connected to the underside of the tray support deck 80 and a distal end 192 pivotally connected to a distal end 194 of the second link 184. The second link 184 has a proximal end 196 pivotally connected to the frame 30. The third link 186 has a forward end 198 connected to the second link 184 intermediate the ends thereof. The third link 186 has a rearward end 200 connected to a distal end 204 of the fourth link 188, which in turn has a proximal end 206 fixedly connected to the underside of the abdominal support deck 100.

As the first link 182 moves up and down, the second link 184 rotates about the proximal end 190. The third link 186, driven by the second link thus moves the abdominal support deck 100 down as the tray support deck 80 moves up and vice versa.

As noted above, as the abdominal support section 16 moves up and down, the leg support moving with it likewise moves up and down. The linkage 170 connected between the rear end 164 of the beam 160 and the slotted member 176 guides the leg support section 20 as it moves towards the stops 150.

Figures 7, 9:
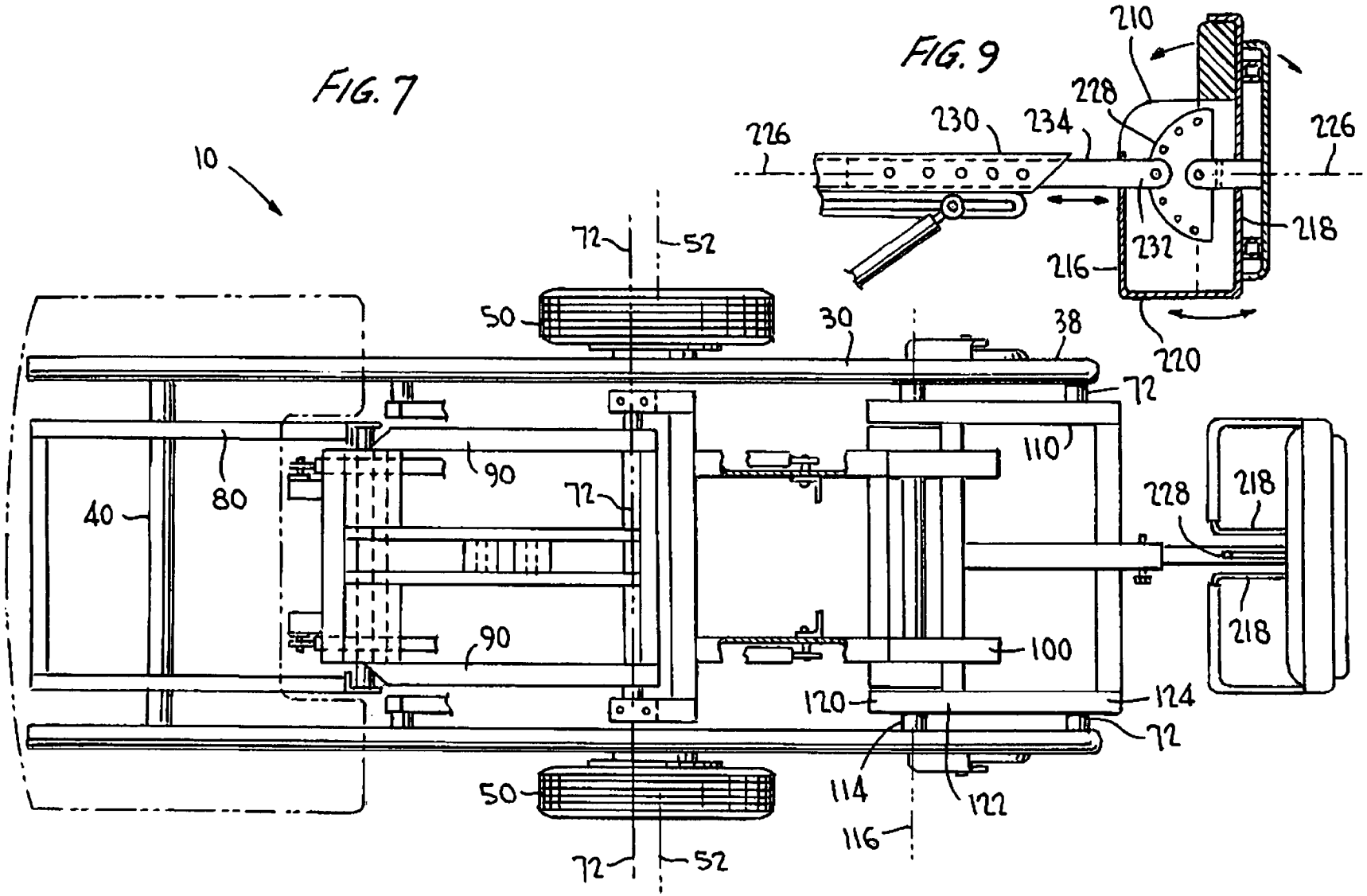
FIG. 7 is a bottom view of the prone cart illustrated in FIG. 1.
FIG. 9. is a fragmentary illustration of a foot support extending from an end of the body support.

FIG. 9 illustrates the foot support 21 which includes a housing 210 in the form of an open container having a front wall 212, a rear or bottom wall 214, lateral side walls 216, a pair or proximate intermediate walls 218 and toe walls 220 forming a left and right compartment 221-222 for receiving the corresponding left and right foot of the patient (not shown). As the patient lies in the prone position, abdomen down on the body support 12, each foot extends toes down into the corresponding compartment 121-122.

The housing 210 is adjustable about a horizontal axis 224 which is disposed transverse to the longitudinal axis 226 of the body support 12. An apertured disk 228 is secured to the housing between the proximate intermediate walls. A forwardly extending support 230 is connected to the disk 228 by a removable pin 232. The support 230 is fixed to the rear end of the leg support by an adjustable telescopic pin 234. The relative position of the foot housing with respect to the leg support may be adjusted longitudinally by the telescopic pin, and the rotational aspect of the housing may be adjusted by rotating the disk with respect to the pin and inserting clips or pins to secure the housing from rotation as the correct and comfortable position of the housing is determined.

Electrical control for the cart 10 is achieved by means of a controller 240 mounted to the frame. The controller 240 is coupled to the electric drive motors 52 which drive the wheels 48 and which in turn are powered by the rechargeable batteries 54. A joystick 244 is mounted on the tray section 14 at a convenient location for use by the patient. The joystick controls forward, reverse, left and right operation of the cart by selectively powering the left and right drive motors, which in turn rotate the wheels in forward and reverse directions.

The drive wheels may operate in the same or opposite sense for facilitating tight control of the cart. For example if the patient is in a congested corridor or if the patient enters a small furnished room, it is possible for the patient to easily maneuver the cart in and around the obstacles in such a corridor or room. This is because the wheels are positioned on an axis 246 located more or less midway along the longitudinal axis 248 of the cart. As a result, the cart can rotate 360° about such axis, with a resulting zero turning radius. In addition, left and right control of the cart is facilitated by independent control of the motor direction as well.

A separate control or joystick 250 may be coupled to the controller 240, batteries 54, and reversible lift motor 128 for raising and lowering the body support. A single joystick may be employed for combining the various functions.

The controller, joystick and reversible drive and lift motors are known devices available in the market. The various linkages described herein may have bearings which are adjustable. For example the third link 186 in the linkage mechanism 180 may have ends which carry bearings mounted to a machine screw. Thus the ends of the link 186, and other linkages in the cart, may be extended or adjusted for optimum performance.

The cushions 92, 102 and 112 are each formed with a 20 mm (¾") plywood base 200, with t-nut fasteners 202. Urethane 65 IFD foam padding 204 overlies the base. The padding has a central area 206 thickness of 50 mm and side bolsters 208 having a thickness of about 75 mm. A viscoelastic memory foam topper 212 overlies the padding 204. A vinyl cover 214, cut and sewn to shape overlies the topper and is attached to the base to enclose the cushion materials.

The invention claimed is:

1. A prone cart comprising:

a frame;

a main support secured centrally of the frame, and a stop support secured rearwardly of the frame below the main support;

an articuable body support being moveable from a prone position to an elevated position including:

a tray support section having a forward end extending forward of the frame and a rearward second end and a linkage portion rotatably secured to the main support, the tray support section being horizontally oriented and being moveable from a first lower position to a second position elevated above the first lower position;

a chest support section supporting the tray support section, said chest support section having a rearward end pivotally secured to the main support and a forward end pivotally secured to the rearward end of the tray support section, the chest support section being rotatable about the rearward end between a first position disposed in a generally horizontal orientation to an second position in an upwardly inclined orientation, and said chest support section and linkage portion being coupled between the rearward end of the tray support section and the main support in parallel alignment such that the tray support section remains horizontally orientated between the first and second positions;

an abdominal support section having a forward end pivotally secured to the main support and a rearward end, the abdominal support section being rotatable about the forward end between a first position disposed in a generally horizontal orientation to a second position in a downwardly inclined orientation, a leg support section having a forward end and a rearward end, the forward end being moveable between a first generally horizontal position and a second position below the first position, the forward end of the leg support section being secured to the rearward end of the abdominal support section for movement therewith, such that the leg support section is horizontally oriented when it is in the first position corresponding to the first position of the abdominal support, and the leg support section is horizontally oriented when it is in the second position corresponding to the second position of the abdominal support section, the leg support section moving with the abdominal support section from the first position to the second position and engaging a stop thereat and counter rotating with respect to the abdominal support section until said abdominal support section reaches the second position and the leg support comes to rest at its second position in the horizontal orientation.

2. The prone cart of claim 1 further comprising: a motor or actuator connected between the frame and the chest support section for driving the chest support section between the first and second positions.

3. The prone cart of claim 1 wherein the frame includes a centrally located drive mechanism for driving the cart in all horizontal directions with zero turning radius.

4. The prone cart of claim 3 further including a controller for the drive mechanism comprising a joy stick for controlling the direction of motion of the cart in all horizontal directions.

5. The prone cart of claim 1 further comprising:

a first mechanism connecting the chest support section and leg support section comprising:

a rocker beam having a forward end and a rearward end, the rocker beam being pivoted to the frame at a point between the ends thereof;

a first coupler having a first end and a second end, the first end being pivotally connected to the forward end of the rocker beam and the second end being pivotally connected to the chest support section;

a second coupler having a first end and a second end, the first end of the second coupler being pivotally connected to the rearward end of the rocker beam and the second end of the second coupler being slidably connected to the leg support section.

6. The prone cart of claim 1 further comprising:

a four bar linkage connecting the tray support section and the chest support section for maintaining the tray support section in the horizontal position as it moves between the first and second positions.

7. The prone cart of claim 1 further comprising:

a second mechanism connecting the abdominal support section and the tray support section comprising:

a bearing element pivotally connected to the frame at one end for movement between a first and a second position;

a rod connected between the bearing element and the tray support section, such that when the bearing element moves between the first position and the second position, the tray support section moves between the lower position and raised position;

a follower connected between the bearing element and the abdominal support section, such that when the bearing element moves between the first position and the second position the abdominal support section moves between the first position and the inclined second position.

8. The prone cart of claim 1 further including a drive mechanism secured centrally of the frame, the drive mechanism including:

a first and a second reversible motor, each motor being independently mounted to the frame and being operable for rotation independently of the other, an outboard drive wheel for each motor for engaging the ground, said drive mechanism for driving the frame in forward and rearward directions when the motors operate in the same direction, and said drive mechanism for driving the frame for rotation about a vertical axis when the motors are driven in opposite directions.

9. The prone cart of claim 8 further including a controller for the drive mechanism comprising a joy stick for controlling the direction of motion of the cart in all horizontal directions.

10. The prone cart of claim 8 further including a suspension for each motor of the drive mechanism, said suspension comprising cradle for each motor, each cradle being mounted to the frame on a common axis transverse to the frame and orthogonally of the vertical axis, each cradle being rotatable about the transverse axis independent of the other such that the wheels each engage the ground independently.

11. The prone cart of claim 1 wherein the frame has four lower corners and further comprising four wheels, one each attached to a corresponding corner of the frame, each wheel being rotatable about a horizontal axis and a vertical axis whereby the frame is rollable along the ground in all directions.

12. The prone cart of claim 1 wherein the tray support section includes a drawer secured to a lower surface thereof for providing storage space for the user, said drawer being slidable forwardly and rearwardly of the tray support section.

13. The prone cart of claim 1 further including a foot support pivotally secured to the rearward end of the leg support section, said foot support including a pocket for receiving the toe end of the foot of a user.

14. The prone cart of claim 13 further comprising an pivotable linkage having an axis transverse to the frame, said linkage for pivotally securing the foot support to the leg support section for rotation about said axis, and a locking mechanism for locking the foot support at a selected angle relative to the leg support section.

15. The prone cart of claim 1 wherein the tray support section has a forward end and a rearward end, the rearward end being connected to the forward end of the chest support section, the tray support section being movable between a lower position and an raised position such that the lower position and elevated position of the tray support section respectively correspond to the lower and raised position of the chest support section.

16. The prone cart of claim 1 wherein the abdominal support section and the leg support section are mounted for concurrent rotation in a first direction and for counter rotation in a second direction.

17. The prone cart of claim 16 wherein the leg support section is secured to the rearward end of the abdominal support section and is carried thereby, said leg support section having a first free end portion extending forwardly and below the abdominal support section and being moveable between a first position and a second position below the first position; a stop secured to the frame near the rearward end of the leg support section near the second position for engaging the leg support section thereat, such that the rearward end of the leg support section is moveable between the first and second positions of the abdominal support section and the free end of the leg support section is moveable between a first horizontal position and a second horizontal position.

18. The prone cart of claim 17, wherein the leg support section is rotatable between a first generally horizontal orientation, an intermediate inclined orientation to a second generally horizontal orientation.

19. The prone cart of claim 1 wherein the frame has side openings and includes cover portions installed within the openings.

20. The prone cart of claim 19 wherein the cover portions are formed of transparent sheet material.

21. A prone cart comprising:

a frame;

a main support secured to the frame;

a body support including a tray, a chest support, an abdominal support, a leg support connected end to end;

the chest support having a first end and a second end, the first end being rotatably connected to the main support for rotation between a generally horizontal lower position and an inclined elevated position;

a lift motor or actuator connected between the frame and the chest support for driving the chest support between the lower and elevated positions;

the abdominal support having a first and second end, the first end being pivotally connected to the main support and being rotatable between a generally horizontal upper position and an inclined lower position;

the leg support having a first end and a second end, the first end of the leg support rotatably connected to the second end of the abdominal support;

a first mechanism connecting the chest support and leg support;

the first mechanism comprising:

a rocker having a first end and second end, being pivoted to the frame at a point between the first and second end;

a first coupler having a first end and a second end, the first end being pivotally connected to the first end of the rocker and the second end is pivotally connected to the chest support;

a second coupler having a first end and a second end, the first end of the second coupler being pivotally connected to the second end of the rocker and the second end of the second coupler being slidably connected to the leg support;

the tray having a first end and a second end, the first end being connected to the second end of the chest support, the tray being movable between a lower position and an raised position such that the lower position and elevated position of the tray respectively correspond to the lower and raised position of the chest support;

a four bar linkage connecting the tray and the chest support for maintaining the tray in the horizontal position;

a second mechanism for connecting the tray to the abdominal support comprising;

a bearing element pivotally connected to the frame at one end for movement between a first and a second position;

a rod connected between the bearing element and the tray, such that when the bearing element moves between the first position and the second position, the tray moves between the lower and raised position;

a follower connected between the bearing element and the abdominal support, such that when the bearing element moves between the first position and the second position the abdominal support moves between the upper position and inclined lower position.

* * * * *